US009644309B2

(12) United States Patent
Park et al.

(10) Patent No.: US 9,644,309 B2
(45) Date of Patent: May 9, 2017

(54) LAUNDRY TREATMENT APPARATUS

(71) Applicant: LG ELECTRONICS INC., Seoul (KR)

(72) Inventors: Soonan Park, Seoul (KR); Dongyoon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/515,968

(22) Filed: Oct. 16, 2014

(65) Prior Publication Data

US 2015/0128656 A1 May 14, 2015

Related U.S. Application Data

(60) Provisional application No. 61/892,150, filed on Oct. 17, 2013.

(30) Foreign Application Priority Data

Sep. 24, 2014 (KR) ..... 10-2014-0127855

(51) Int. Cl.
*D06F 39/08* (2006.01)
*D06F 39/12* (2006.01)

(52) U.S. Cl.
CPC ..... *D06F 39/12* (2013.01); *D06F 39/083* (2013.01)

(58) Field of Classification Search
None
See application file for complete search history.

(56) References Cited

U.S. PATENT DOCUMENTS 4,860,791 A * 8/1989 Putnam ..... D06F 39/12 137/565.01
2012/0255330 A1* 10/2012 Wanweerakul ..... D06F 39/083 68/208

FOREIGN PATENT DOCUMENTS

CN 1755019 4/2006
CN 101851840 10/2010
KR 10-2008-0102592 * 11/2008

OTHER PUBLICATIONS

Chinese Office Action dated May 23, 2016. (translation).

* cited by examiner

*Primary Examiner* — Michael Barr
*Assistant Examiner* — Jason Riggleman
(74) *Attorney, Agent, or Firm* — KED & Associates, LLP

(57) ABSTRACT

A casing defines an external appearance of a laundry treatment apparatus. The casing has a through-hole and an outer tub placed within the casing. The outer tub is configured to receive wash water therein, and a hose extends outward through the through-hole. The hose serves to outwardly discharge the wash water received in the outer tub. A connector comprises a pair of pivotally movable parts connected to each other to tighten the hose and to secure the hose to the through-hole.

12 Claims, 9 Drawing Sheets

LAUNDRY TREATMENT APPARATUS

CROSS-REFERENCE TO RELATED APPLICATIONS

This application claims priority benefit of prior U.S. Provisional Application No. 61/892,150 filed on Oct. 17, 2013 and Korean Patent Application No. 10-2014-0127855, filed on Sep. 24, 2014 in the Korean Intellectual Property Office, the disclosures of which are incorporated herein by reference.

BACKGROUND DISCLOSURE

1. Field

The present disclosure relates to laundry treatment apparatuses and, more particularly, to connectors to secure hoses to casings.

2. Background

Generally, laundry treatment apparatuses are classified into 3 following categories: washing machines that remove contaminants from clothes, bed sheets and other items (hereinafter referred to as "fabric") using water, detergent, mechanical action and the like; drying machines that dry wet fabrics using dry hot air heated by a heater, mechanical action and the like; and combined drying and washing machines that have both a washing function and a drying function.

Among the laundry treatment apparatuses, the washing machines may be classified into top load type washing machines in which a fabric introduction/removal opening for introduction and removal of fabric is formed at the top of a cabinet and washing is performed using a rotating water stream generated upon rotation of an inner tub, and drum type washing machines in which a fabric introduction/removal opening is formed at the front side of a cabinet and washing is performed by tumbling of fabric upon rotation of a drum.

A top load type washing machine includes a cabinet that defines an external appearance of the washing machine and has an open top side. A top cover is coupled to the open top side of the cabinet and has a fabric introduction/removal opening. A door is pivotally rotatably coupled to the fabric introduction/removal opening, and a base is placed under the cabinet. An outer tub is placed within the cabinet to store water therein, and an inner tub placed within the outer tub, where washing of fabric occurs in the inner tub.

A motor device is mounted under the inner tub to rotate the inner tub, a water supply device to supply water into the outer tub, and a drain device to discharge water out of the outer tub. In addition, the washing machine includes a detergent supply device placed in communication with the water supply device to supply detergent during supply of water. The drain device includes a hose to discharge water out of the casing. A connector is installed to the casing to secure the hose to the casing.

The hoses have a complicated structure consisting of two separate parts, one of which is connected to the connector within the casing and the other of which is connected to the connector at the outside of the casing. The hoses have problems, such as inconvenient assembly, leakage of water, and a complicated manufacturing process.

BRIEF DESCRIPTION OF THE DRAWINGS

The embodiments will be described in detail with reference to the following drawings in which like reference numerals refer to like elements wherein.

DETAILED DESCRIPTION

Figure 1:
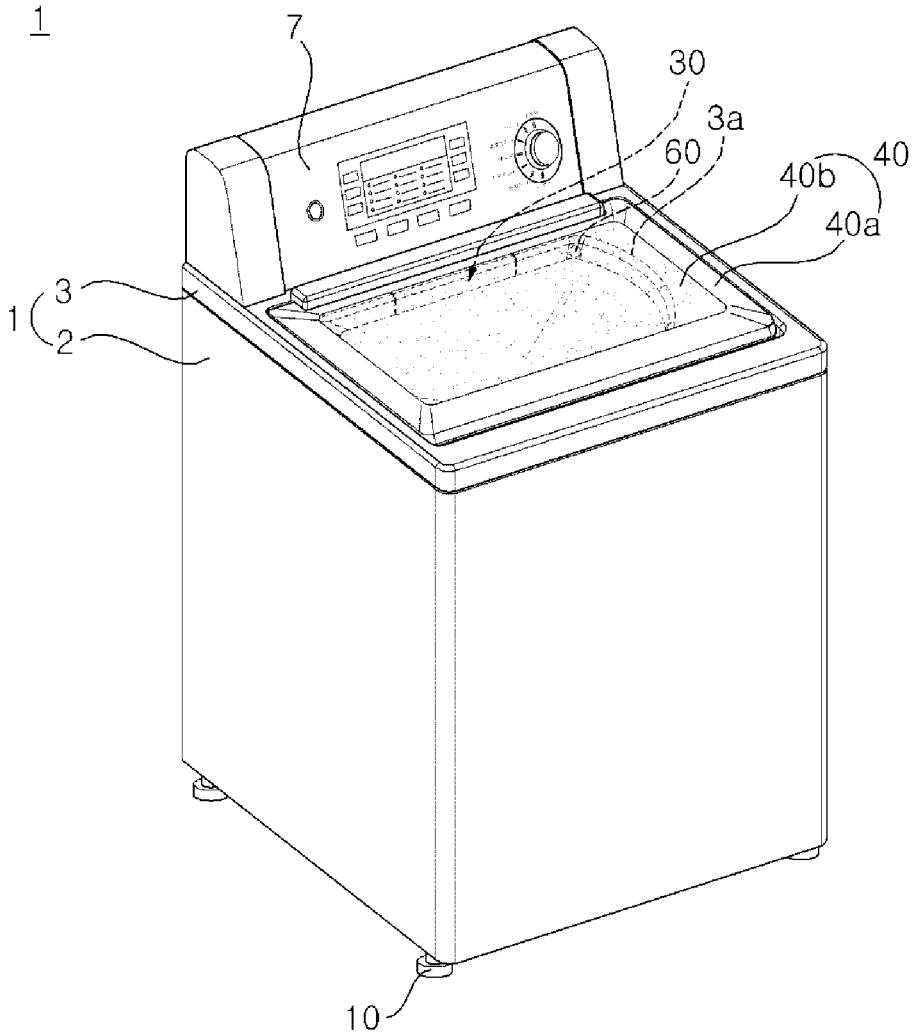
FIG. 1 is a perspective view of a top load type washing machine according to one embodiment of the present disclosure.
Figure 2:
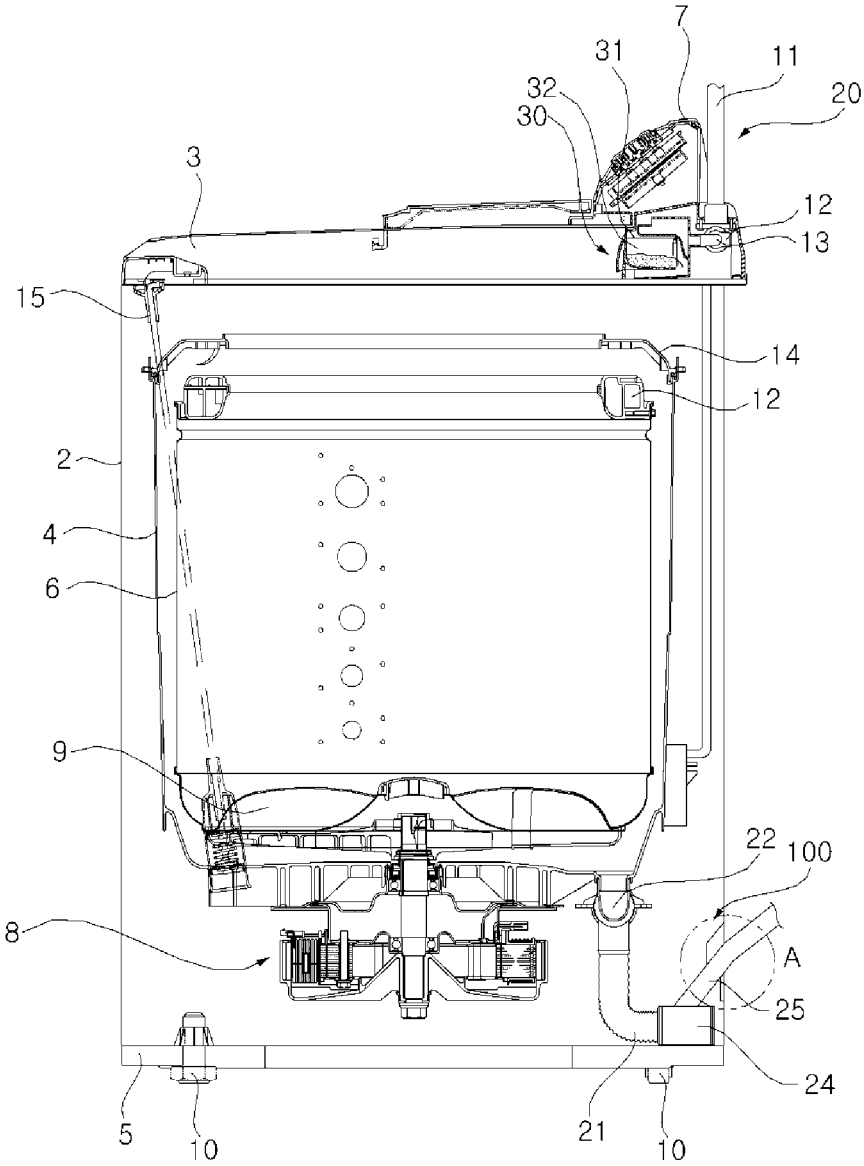
FIG. 2 is a longitudinal sectional view of the washing machine shown in FIG. 1.
Figure 3:
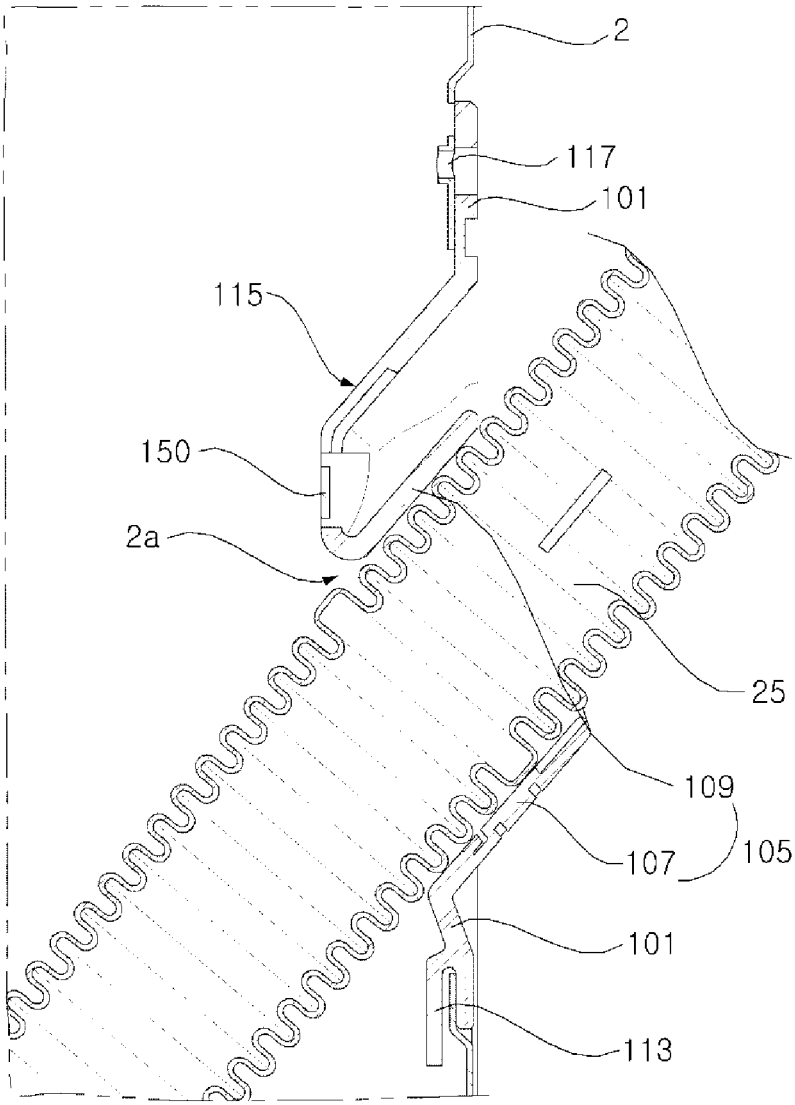
FIG. 3 is an enlarged view of circle A shown in FIG. 2.

FIG. 1 is a perspective view of a top load type washing machine according to one embodiment of the present disclosure. FIG. 2 is a longitudinal sectional view of the washing machine shown in FIG. 1. FIG. 3 is an enlarged view of circle A shown in FIG. 2.

Referring to FIGS. 1 to 3, the washing machine according to one embodiment of the present disclosure includes a casing 1 defining an external appearance of the apparatus. The casing 1 includes a through-hole 2*a*, and an outer tub 4 placed within the casing 1 to receive wash water therein. A hose 25 extends outward through the through-hole 2*a* to discharge the wash water out of the outer tub 4. A connector 100 comprises a pair of separable parts which are pivotally and movably connected to each other. The connector 100 serves to tighten the hose 25 and to secure the hose 25 to the through-hole 2*a*. A pivotal movement direction of the connector 100 is a longitudinal direction of the hose 25.

In one embodiment of the present disclosure, the washing machine may include the casing 1 that defines an external appearance of the washing machine and has the perforation 2*a* through which the hose 25 passes. The hose 25 is configured to pass through the through-hole 2*a*. The connector 100 is positioned in the through-hole 2*a* to secure the hose 25 to the through-hole 2*a*. The connector 100 is configured to surround the circumference of the hose 25 in a longitudinal direction of the hose 25 so as to be secured to the hose 25.

The casing 1 includes a cabinet 2 having open top and bottom surfaces to define side surfaces of the washing machine. A top cover 3 is installed to the cabinet 2 to cover the open top surface, and a base 5 is installed to the cabinet 2 to cover the open bottom surface. The cabinet 2 is provided with the outer tub 4 in which water is received, and an inner tub 6 placed within the outer tub 4 to receive laundry therein. A drive device 8, such as a motor or the like, drives the inner tub 6, and a water supply assembly supplies water into the outer tub 4. A drain assembly 20 discharges water out of the outer tub 4 after completion of washing or dehydration.

The casing 1 further accommodates a detergent supply device 30 installed in the top cover 3 to temporarily store detergent therein. The detergent supply device 30 is connected to the water supply assembly to allow detergent to be supplied along with water into the inner tub 6.

The top cover 3 has a fabric introduction/removal opening 3*a* to allow fabric to be introduced or removed therethrough. A door 40 is installed to the top cover 3 to open or close the fabric introduction/removal opening 3*a*. At least a portion of the door 40 may be formed of glass or plastic to allow a user to view the interior of the washing machine. The door 40 includes a frame 40*a* and a glass 40*b* fitted into the frame 40*a*. A display panel 7 for input of an operation command of the washing machine or for display of an operational state of the washing machine is mounted to the top cover 3.

The outer tub 4 is suspended from an inner ceiling of the cabinet 2 via a plurality of suspensions 15. One end of each suspension 15 may be coupled to the inner ceiling of the cabinet 2 and the other end of the suspension 15 may be coupled to the bottom of the outer tub 4. A pulsator 9 to create a rotating stream of water received in the outer tub 4 is mounted on a bottom surface of the inner tub 6. The pulsator 9 may be integrally formed with the inner tub 6 such that the inner tub 6 and the pulsator 9 are rotated together upon rotation of the motor. Alternatively, the pulsator 9 and the inner tub 6 may be separately formed from each other so as to be rotated separately upon rotation of the motor.

A balancer 12 is mounted to the top of the inner tub 6 to prevent the inner tub 6 from becoming unbalanced due to fabric unbalance. The balancer 12 may be a liquid balancer filled with liquid, such as salt water or the like. An outer tub cover 14 is mounted to the top of the outer tub 4 to prevent unwanted discharge of fabric or scattering of water.

The water supply assembly includes an outer hose 11 to guide water, which supplied from an external water tap or the like, to the washing machine. A water supply valve 12 is connected to the outer hose 11 to control supply of water. A water supply hose 13 is connected to the water supply valve 12 and the detergent supply device 30 to each other. The water supply valve 12 and the water supply hose 13 define a water supply path along which water is supplied.

The detergent supply device 30 is located in the water supply path. The detergent supply device 30 includes a detergent box housing 31 in communication with the water supply hose 13, a detergent box 32 separably received in the detergent box housing 31, and a detergent box cover secured to the detergent box housing 31 and located at the top of the detergent box 32 to eject water. The detergent box housing 31 is seated in a detergent box mount formed at one side of the top cover 3.

The detergent box 32 is separably coupled to the detergent box housing 31 to allow a user to pull the detergent box 32 out of the detergent box housing 31 to introduce detergent into the detergent box 32. For example, the detergent box 32 may be coupled to the detergent box housing 31 so as to slide forward or rearward. At least a portion of a rear surface of the detergent box 32 is open. As such, upon supply of water, water and detergent may be mixed and introduced into the detergent box housing 31 through the rear surface of the detergent box 32. The drain assembly 20 may be located between the outer tub 4 and the base 5.

The drain assembly 20 includes a flow member 21 and a drain pump housing 24 connected to the flow member 21 for pumping of water. A drain motor (not shown) to drive a drain pump (not shown) is received in the drain pump housing 24. The hose 25 is connected to the drain pump housing 24 to define a flow path along which water is discharged out of the casing 1. The through-hole 2*a* is formed in the cabinet 2. The through-hole 2*a* is a hole for passage of the hose 25. The through-hole 2*a* is perforated in a lower rear region of the cabinet 2. The connector 100 is located in and secured to the through-hole 2*a*.

Figure 4:
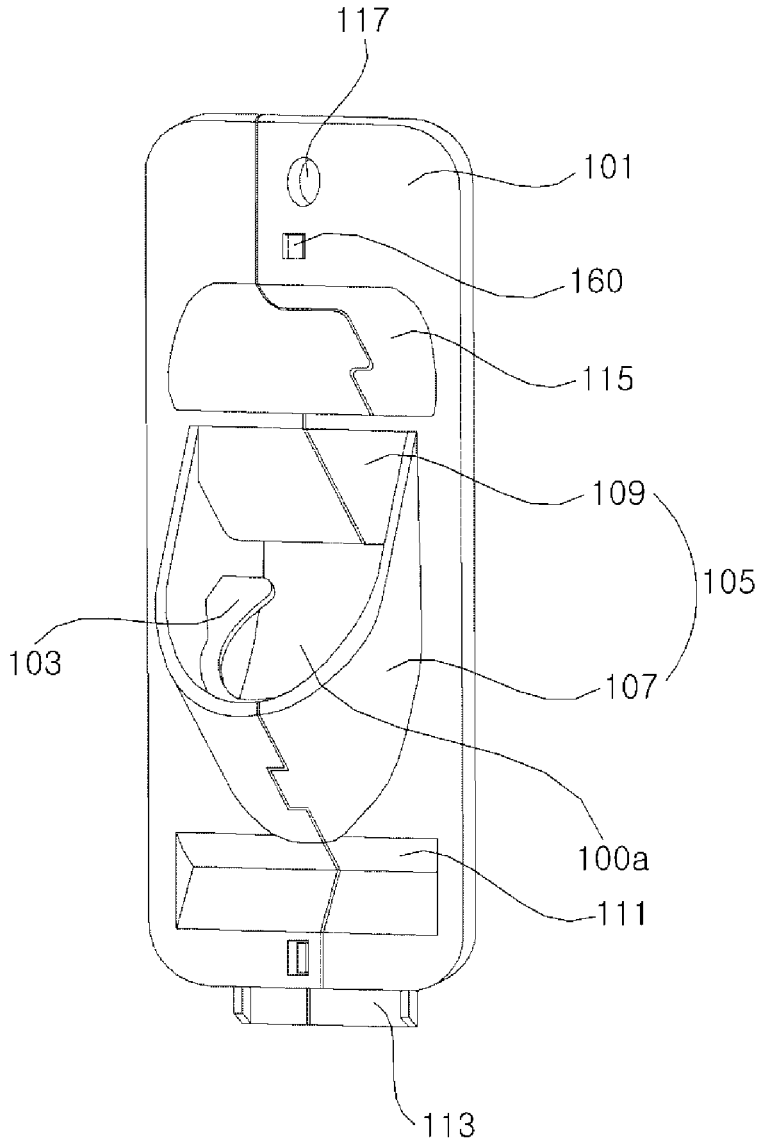
FIG. 4 is a perspective view of a connector according to one embodiment of the present disclosure.
Figure 5:
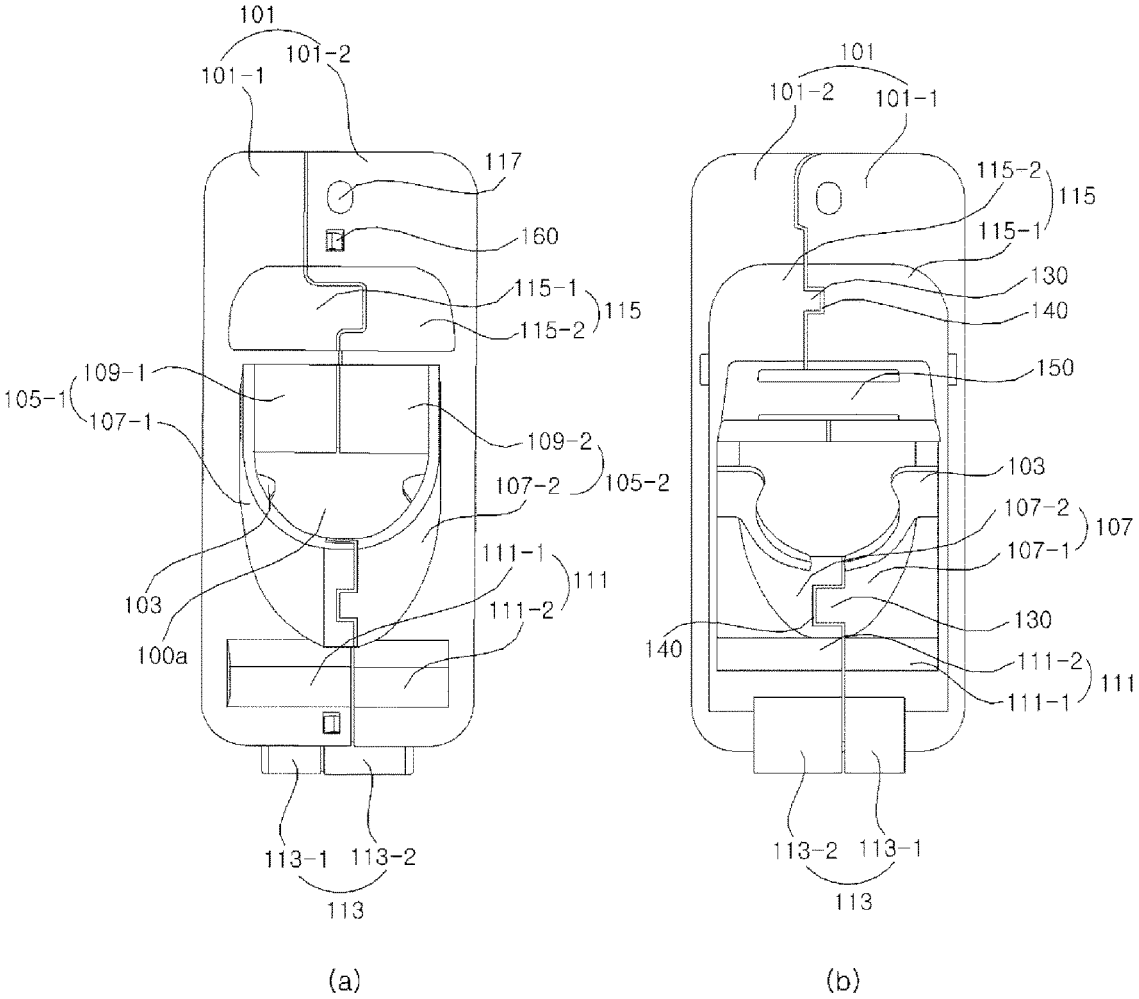
FIG. 5 is a front view of the connector and a rear view of the connector.
Figure 6:
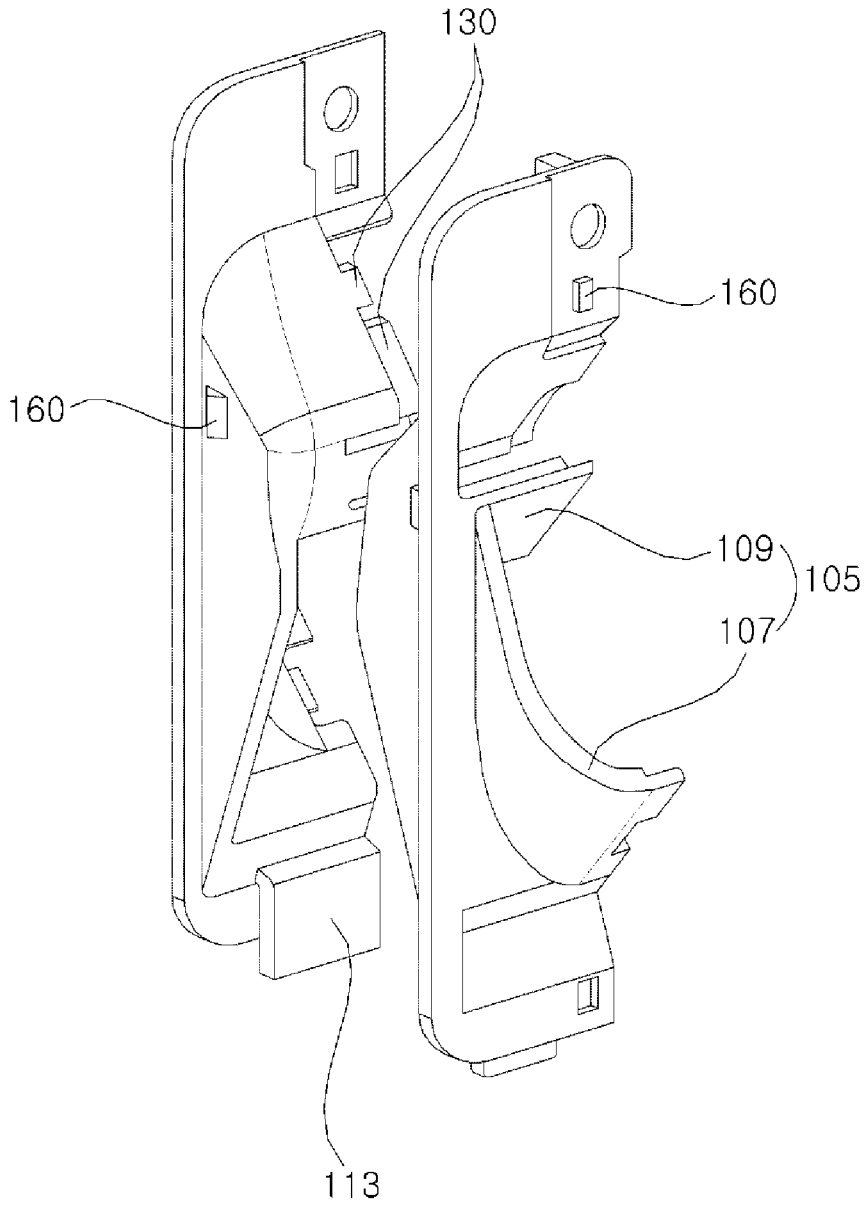
FIG. 6 is a perspective view showing a separated state of the connector according to one embodiment of the present disclosure.
Figure 7:
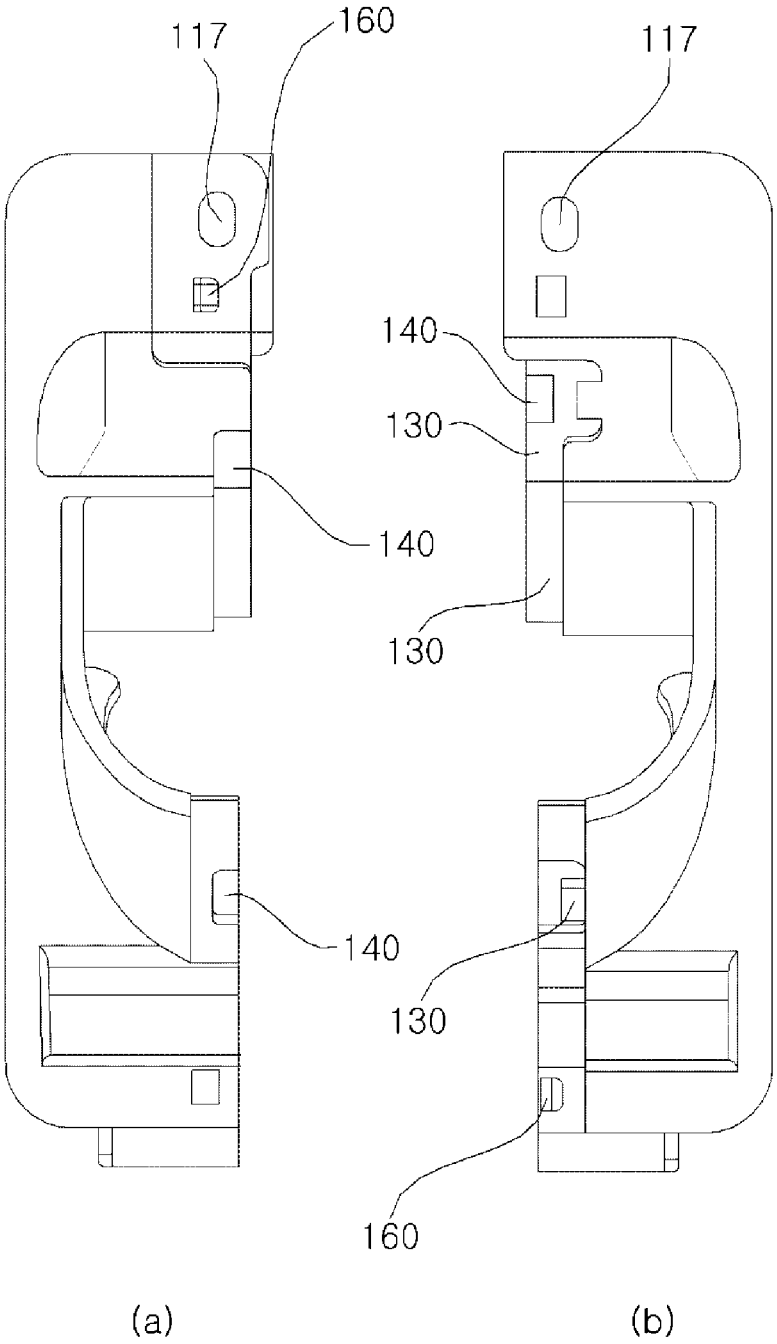
FIG. 7 is a front view showing a separated state of the connector according to one embodiment of the present disclosure.

FIG. 4 is a perspective view of the connector 100 according to one embodiment of the present disclosure. FIG. 5(*a*) is a front view of the connector 100 and FIG. 5(*b*) is a rear view of the connector 100. FIG. 6 is a perspective view showing a separated state of the connector 100 according to one embodiment of the present disclosure. FIG. 7 is a front view showing a separated state of the connector 100 according to one embodiment of the present disclosure.

Referring to FIGS. 4 to 7, the connector 100 includes a body 101 that is coupled to the casing 1 and has a hose arrangement hole 100*a* through which the hose 25 passes, and stoppers 103 that protrude from the edge of the hose arrangement hole 100*a*. The stoppers 103 are configured to be fitted between pleats of the bellows-like hose 25 to restrict movement of the hose 25. The hose arrangement hole 100*a* formed in the body 101 serves as a space for insertion of the hose 25. The body 101 may include a first body 101-1 and a second body 101-2, thereby causing the connector 100 to be divided into a pair of parts. The stoppers 103 formed at the hose arrangement hole 100*a* may include a first stopper 103 formed at the first body 101-1 and a second stopper 103 formed at the second body 101-2. The bellows-like hose 25 has a plurality of pleats such that the stoppers 103 are fitted or inserted between the pleats of the hose 25. In the case of the body 101 consisting of the first body 101-1 and the second body 102-2, the first body 101-1 constitutes a first fixing part 121 and the second body 101-2 constitutes a second fixing part 122. The first body 101-1 and the second body 101-2 are secured to the cabinet 2.

The first fixing part 121 and the second fixing part 122 of the connector 100 that will be described below are movable in a longitudinal direction of the hose 25. Specifically, the first fixing part 121 and the second fixing part 122 are movable in arcs in a longitudinal direction of the hose 25. The first fixing part 121 and the second fixing part 122 may perform circular movement toward the center of the hose 25. The first fixing part 121 and the second fixing part 122 may perform pivotal movement about the center of the hose 25. The first fixing part 121 and the second fixing part 122 are coupled to each other so as to be wound around the hose 25.

The connector 100 includes a guide portion 105 provided in a longitudinal direction of the hose 25. The hose arrangement hole 100*a* is defined by the guide portion 105 and the stoppers 103 are formed at an inner surface of the guide portion 105.

More specifically, the guide portion 105 may extend in a longitudinal direction of the hose 25 and define the hose arrangement hole 100*a* therein. The guide portion 105 may have a circular shape. Alternatively, part of the guide portion 105 may be circularly curved and the other part of the guide portion 105 may have a planar shape. The connector 100 further includes an engagement induction piece 150 for connection of the first and second bodies 101-1 and 101-2. The guide portion 105 includes an elastic pressure portion 109 configured to come into surface contact with an outer circumferential surface of the hose 25. The elastic pressure portion 109 and the engagement induction piece 150 have a gap therebetween. As such, the elastic pressure portion 109 functions to elastically compress the outer circumferential surface of the hose 25.

The guide portion 105 may further include a curved portion 107 that will be described below, in addition to the elastic pressure portion 109. The guide portion 105 may generally have an inclined shape, in order to assist the hose 25 in moving in a desired direction. The guide portion 105 may be divided into a first guide portion 105-1 and a second guide portion 105-2. The first guide portion 150-1 is formed at the first body 101-1, and the second guide portion 105-2 is formed at the second body 101-2. The first guide portion 105-1 and the second guide portion 105-2 serve to secure the hose 25 by being coupled to each other. For example, the first guide portion 105-1 and the second guide portion 105-2 are coupled to each other to support the hose 25 such that the hose 25 extends in a given direction.

The curved portion 107 of the guide portion 105 is shaped to surround the hose 25 and internally provided with the stoppers 103. To surround the hose 25, the curved portion 107 may have an approximately circular shape. The stoppers 103 may be formed at an inner surface of the curved portion 107.

The body 101 is provided with a retainer portion 111 that is located at a lower end of the guide portion 105 and configured to extend in a longitudinal direction of the hose 25. The retainer portion 111 serves to support the hose 25 deviating from the guide portion 105. As described above, the body 101 may be divided into the first body 101-1 constituting the first fixing part 121 and the second body 101-2 constituting the second fixing part 122.

In consideration of the fact that the drain pump (not shown) and the drain pump housing 24 are arranged in a lower region of the casing 1, the hose 25 may be installed to obliquely penetrate the casing 1 and, more particularly, to obliquely penetrate the cabinet 2. The hose 25 may come into contact at a lower end thereof with the guide portion 105 and the retainer portion 111. For example, the lower end of the hose 25 may come into contact with the curved portion 107.

The connector 100 further includes an insert piece 113 configured to protrude from the body 101 so as to define a gap with the body 101 for insertion of an edge of the through-hole 2*a*. The insert piece 113 may have an approximately "L"-shaped form. Thus, the insert piece 113 may take the form of a hook or a stepped piece. The insert piece 113 and the body 101 have a gap therebetween such that the edge of the through-hole 2*a* is inserted into the gap.

The connector 100 includes the first fixing part 121 that is secured to the through-hole 2*a* and defines a portion of the hose arrangement hole 100*a* through which the hose 25 passes and the second fixing part 122 that is secured to the through-hole 2*a* and defines the remaining portion of the hose arrangement hole 100*a*, the second fixing part 122 being separably coupled to the first fixing part 121 to secure the hose 25.

The first fixing part 121 and the second fixing part 122 are coupled to each other to define the hose arrangement hole 100*a*. As such, the first fixing part 121 and the second fixing part 122 serve to secure the hose 25. The first fixing part 121 and the second fixing part 122 are mounted to the cabinet 2. In other words, the first fixing part 121 and the second fixing part 122 are mounted to the casing 1.

The first fixing part 121 and the second fixing part 122 may be engaged with each other using an engagement protrusion 130 and an engagement recess 140 formed at contact surfaces thereof. As needed, a plurality of engagement protrusions 130 and a plurality of engagement recesses 140 may be provided. The engagement protrusion 130 and the engagement recess 140 may be formed at the first fixing part 121 and/or the second fixing part 122. The first fixing part 121 and the second fixing part 122 are movable in a longitudinal direction of the hose 25 to thereby be coupled to each other.

Once the first fixing part 121 and the second fixing part 122 are coupled to each other using the engagement protrusion 130 and the engagement recess 140, the first fixing part 121 and the second fixing part 122 are no longer moved in a longitudinal direction of the hose 25. In addition, to prevent the first fixing part 121 and the second fixing part 122 from being moved in a circumferential direction of the hose 25, a snap-fit structure including, for example, a hook 160, as well as the engagement induction piece 150 are provided.

Figure 8:
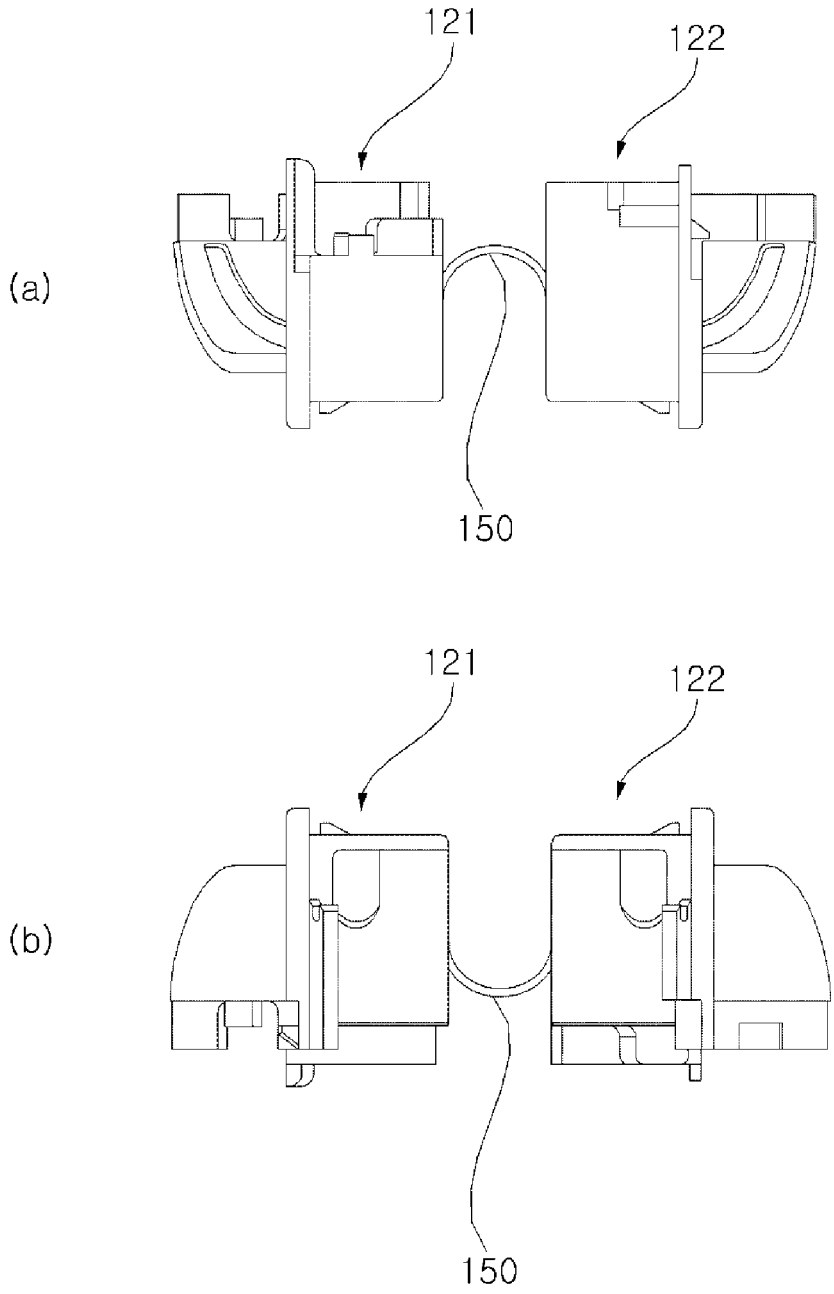
FIG. 8 is a top view showing a separated state of the connector and a bottom view showing a separated state of the connector.
Figure 9:
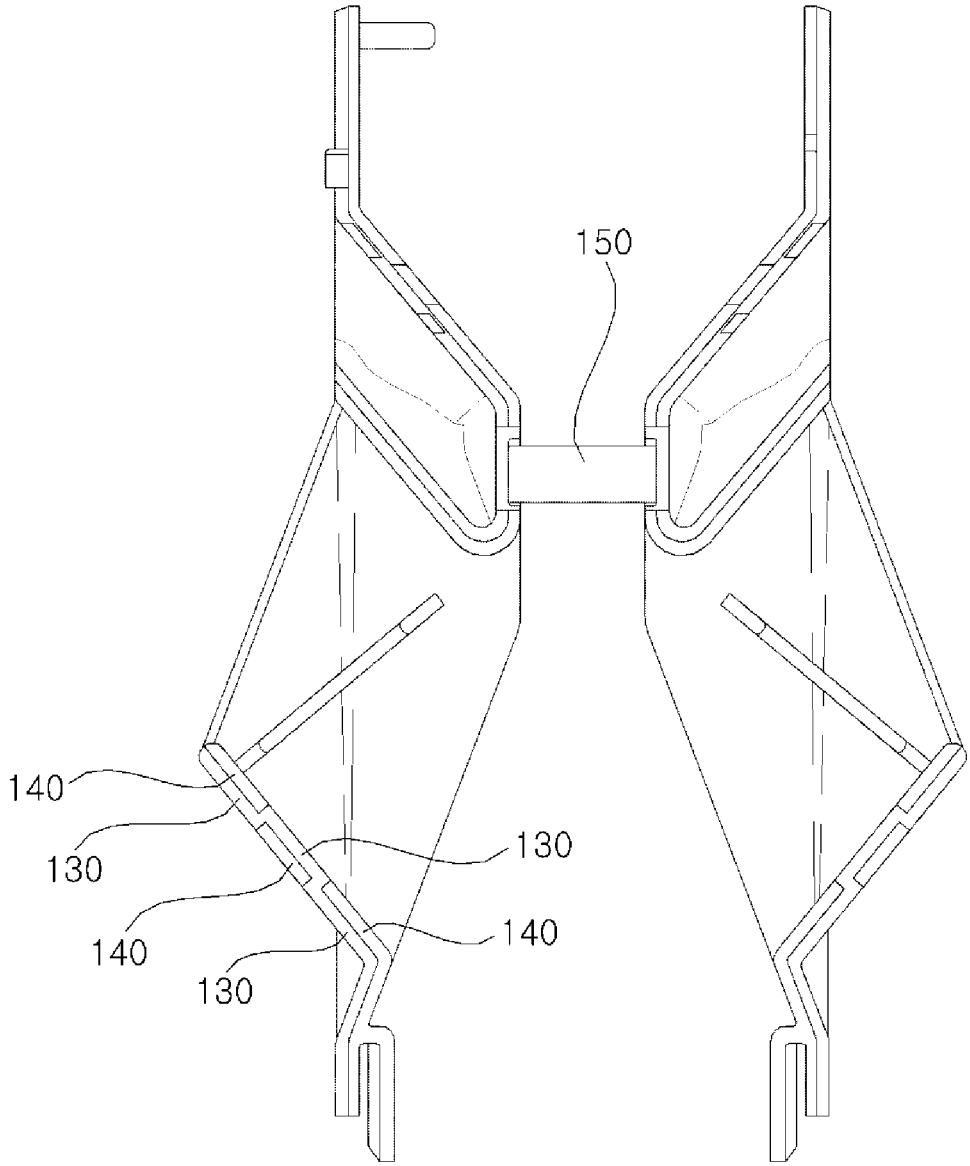
FIG. 9 is a view showing an inner configuration of the connector in an unfolded state thereof according to one embodiment of the present disclosure.

FIG. 8(*a*) is a top view of a separated state of the connector 100 and FIG. 8(*b*) is a bottom view of a separated state of the connector 100. FIG. 9 is a view showing an inner configuration of the connector 100 in an unfolded state thereof according to one embodiment of the present disclosure.

Referring to FIGS. 8 and 9, the connector 100 includes the engagement induction piece 150 that connects the first fixing part 121 and the second fixing part 122 to each other such that the first fixing part 121 and the second fixing part 122 are rotatable to be engaged with each other.

More specifically, the engagement induction piece 150 is configured to connect the first fixing part 121 and the second fixing part 122 to each other. The engagement induction piece 150 connects the first body 101-1 and the second body 101-2 to each other. The engagement induction piece 150 may be arranged parallel to a radial direction of the hose 25. The engagement induction piece 150 allows movement of the first fixing part 121 and the second fixing part 122 in a given direction, but prevents the first fixing part 121 and the second fixing part 122 from being moved in the same direction after coupling thereof. The engagement induction piece 150 has a length to ensure that the first fixing part 121 and the second fixing part 122 coupled to each other may come into close contact with each other.

The engagement induction piece 150 may be connected to the first and second fixing parts 121 and 122 at positions spaced apart from at least one of the engagement protrusion 130 and the engagement recess 140. The engagement induction piece 150 induces gradual reduction in a distance between the first fixing part 121 and the second fixing part 122 until the first and second fixing parts 121 and 122 are engaged with each other.

For example, one end of the engagement induction piece 150 is connected to an approximately middle point of the first fixing part 121 and the other end of the engagement induction piece 150 is connected to an approximately middle point of the second fixing part 122. As such, easy engagement is accomplished when the engagement induction piece 150 allows the first fixing part 121 and the second fixing part 122 to begin to access each other in a state in which they are spaced apart from each other by a prescribed distance.

The connector 100 includes the first guide portion 105-1 that is formed at the first fixing part 121, defines the hose arrangement hole 100*a* and extends in a longitudinal direction of the hose 25, the second guide portion 105-2 that is formed at the second fixing part 122, defines the hose arrangement hole 100*a* and extends in a longitudinal direction of the hose 25 so as to be coupled to the first guide portion 105-1. A first protruding portion 115-1 that extends from one end of the first guide portion 105-1 and is bent to internally define a space, and a second protruding portion 115-2 that extends from one end of the second guide portion 105-2 and is bent to internally define the space by being coupled to the first protruding portion 115-1.

The first protruding portion 115-1 and the second protruding portion 115-2 constitute a single protruding portion 115. The protruding portion 115 may be formed at an upper end of the guide portion 105. The protruding portion 115 may extend parallel to the guide portion 105. The protruding portion 115 may extend parallel to the hose 25.

The engagement induction piece 150 may have one end coupled to the first protruding portion 115-1 and the other end coupled to the second protruding portion 115-2. The engagement induction piece 150 may have one end coupled to the first body 101-1 and the other end coupled to the second body 101-2.

The first guide portion 105-1 includes a first curved portion 107-1 surrounding the hose 25 and a first elastic pressure portion 109-1 connected to the first protruding portion 115-1 and having a plane parallel to a longitudinal direction of the hose 25.

The second guide portion 105-2 includes a second curved portion 107-2 surrounding the hose 25 and a second elastic pressure portion 109-2 connected to the second protruding portion 115-2 and having a plane parallel to a longitudinal direction of the hose 25.

The washing machine according to one embodiment of the present disclosure includes the casing 1 that defines an external appearance of the washing machine and has the through-hole 2*a* for passage of the hose 25, the hose 25 passing through the through-hole 2*a*, and the connector 100 configured to secure the hose 25 to the through-hole 2*a*, and the connector 100 includes the guide portion 105 to keep the hose 25 in a tilted state and the body 101 orthogonally coupled to the casing 1 and provided with the guide portion 105.

The washing machine according to one embodiment of the present disclosure includes the casing 1 that defines an external appearance of the washing machine and has the through-hole 2*a* for passage of the hose 25, the hose 25 passing through the through-hole 2*a*, and the connector 100 that is bent in a longitudinal direction of the hose 25 such that both ends of the connector 100 are coupled to each other to define the hose arrangement hole 100*a* for insertion of the hose 25 therebetween, the connector 100 being mounted in the through-hole 2*a*.

The hook 160 may be located at the first fixing part 121 and/or the second fixing part 122. The first fixing part 121 and the second fixing part 122 are secured to each other via the hook 160. The hook 160 may also serve to couple the connector 100 to the cabinet 2.

The connector 100 has a bolting hole 117. The first fixing part 121 and the second fixing part 122 may be provided respectively with the bolting holes 117. Once the first fixing part 121 and the second fixing part 122 are coupled to each other, the bolding holes 117 may overlap each other to form a single hole. As a bolt is fastened through the bolting hole 117, the connector 100 is coupled to the cabinet 2.

As is apparent from the above description, the present disclosure provides one or more effects as follows.

First, use of an integrally formed hose provides an advantage of reducing a risk of water leakage.

Second, easy connection of a hose provides an advantage of simplifying a manufacturing process.

Therefore, the present disclosure has been made in view of the above problems, and it is one object of the present disclosure to provide a connector which may allow a single hose to directly penetrate the casing.

It is another object of the present disclosure is to provide a connector which may be simply assembled and used to secure a hose.

Objects of the present disclosure should not be limited to the aforementioned objects and other not-mentioned objects will be clearly understood by those skilled in the art from the following description.

In accordance with an embodiment of the present disclosure, the above and other objects can be accomplished by the provision of a laundry treatment apparatus including a casing defining an external appearance of the laundry treatment apparatus, the casing having a through-hole, an outer tub placed within the casing, the outer tub being configured to receive wash water therein, a hose extending outward through the through-hole, the hose serving to outwardly discharge the wash water received in the outer tub and a connector divided into a pair of parts pivotally movably connected to each other to tighten the hose and to secure the hose to the through-hole, the connector being pivotally moved in a longitudinal direction of the hose.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment apparatus comprising:

a casing having a through-hole;

an outer tub placed within the casing, the outer tub being configured to receive wash water therein;

a hose extending outward through the through-hole, the hose serving to outwardly discharge the wash water from in the outer tub; and a connector having a pair of pivotally movable parts, pivotally movable in a longitudinal direction of the hose, connected to each other to tighten the hose and to secure the house to the through-hole, wherein the connector includes:

a first fixing part secured to the through-hole, the first fixing part defining a portion of a hose arrangement hole for passage of the hose;

a second fixing part secured to the through-hole, the second fixing part defining the remaining portion of the hose arrangement hole, the second fixing part being separably coupled to the first fixing part to secure the hose;

an engagement induction piece configured to connect the first fixing part and the second fixing part to each other such that the first fixing part and the second fixing part are rotatable to be engaged with each other;

a first guide portion formed at the first fixing part, the first guide portion defining the hose arrangement hole and extending in a longitudinal direction of the hose; and a second guide portion formed at the second fixing part, the second guide portion defining the hose arrangement hole and extending in a longitudinal direction of the hose so as to be coupled to the first guide portion.

2. The apparatus of claim 1, wherein the connector includes:

a body coupled to the casing and having the hose arrangement hole for passage of the hose, the body comprising the pair of pivotally movable parts; and a stopper protruding from an edge of the hose a arrangement hole, the stopper being configured to be fitted between pleats of the hose to restrict movement of the hose.

3. The apparatus of claim 2, wherein the stopper is formed at an inner surface of the first and second guide portions extending in a longitudinal direction of the hose.

4. The apparatus of claim 3, wherein the first and second guide portions include an elastic pressure portion configured to come into surface contact with an outer circumferential surface of the hose; and the elastic pressure portion defines a gap with the engagement induction piece to elastically compress the outer circumferential surface of the hose.

5. The apparatus of claim 3, wherein the first and second guide portions include a curved portion surrounding the hose, the stopper being formed at an inner surface of the curved portion.

6. The apparatus of claim 3, wherein the body includes a retainer portion located at a lower end of the first and second guide portions, the retainer portion extending in a longitudinal direction of the hose to support the hose deviating from the guide portions.

7. The apparatus of claim 2, wherein the connector includes an insert piece protruding from the body to define a gap with the body for insertion of an edge of the through-hole.

8. The apparatus of claim 1, wherein the first fixing part and the second fixing part are provided at contact surfaces thereof with an engagement protrusion and an engagement recess respectively so as to be engaged with each other.

9. The apparatus of claim 1, wherein the engagement induction piece is connected to the first fixing part and the second fixing part at a position spaced apart from at least one of the engagement protrusion and the engagement recess.

10. The apparatus of claim 9, wherein the connector includes:

a first protruding portion extending from one end of the first guide portion and then bent to internally define a space; and a second protruding portion extending from one end of the second guide portion and then bent to internally define the space by being coupled to the first protruding portion.

11. The apparatus of claim 10, wherein the first guide portion includes:

a first curved portion surrounding the hose; and a first elastic pressure portion connected to the first protruding portion, the first elastic pressure portion having a plane parallel to a longitudinal direction of the hose.

12. The apparatus of claim 1, wherein the engagement induction piece is made of an elastic material.

* * * * *